US006287030B1

(12) United States Patent
Furuya et al.

(10) Patent No.: US 6,287,030 B1
(45) Date of Patent: Sep. 11, 2001

(54) TAPE-PRINTING APPARATUS WITH CONTROL OF FEEDING AND CUTTING OF A TAPE

(75) Inventors: Yoshikiyo Furuya; Yoshiyuki Takeuchi, both of Nagano; Kenji Watanabe, Tokyo; Takanobu Kameda, Tokyo; Tomoyuki Shimmura, Tokyo; Chieko Aida, Tokyo, all of (JP)

(73) Assignees: Seiko Epson Corporation; King Jim Co., Ltd., both of Tokyo (JP)

( * ) Notice: Subject to any disclaimer, the term of this patent is extended or adjusted under 35 U.S.C. 154(b) by 0 days.

(21) Appl. No.: 09/563,666

(22) Filed: May 2, 2000

Related U.S. Application Data

(62) Division of application No. 08/829,736, filed on Apr. 1, 1997.

(30) Foreign Application Priority Data

Apr. 15, 1996 (JP) ..... 8-092892
Jan. 14, 1997 (JP) ..... 9-017525

(51) Int. Cl.[7] ..... B41J 11/30; B41J 11/44; B41J 5/30

(52) U.S. Cl. ..... 400/615.2; 400/76; 400/70; 400/61

(58) Field of Search ..... 400/615.2, 76, 400/70, 61

(56) References Cited

U.S. PATENT DOCUMENTS 5,222,818 * 6/1993 Akiyama et al. ..... 400/61
5,295,753 * 3/1994 Godo et al. ..... 400/612
5,741,082 * 4/1998 Toya ..... 400/615.2
5,913,624 * 6/1999 Ikegami ..... 400/621
6,109,798 * 8/2000 Nunokawa et al. ..... 400/83

* cited by examiner

*Primary Examiner*—John S. Hilten
*Assistant Examiner*—Charles H. Nolan, Jr.
(74) *Attorney, Agent, or Firm*—Hogan & Hartson, L.L.P.

(57) ABSTRACT

There is provided a printing apparatus for printing on a continuous tape. When a portion of a continuous tape having passed a thermal head is cut at a predetermined cutting position, a stepping motor is caused to stop driving the platen roller for rotation to stop feeding of the tape, and then the tape is cut off. During tape-cutting operation, the stepping motor is held in an energized state. When the printing operation is resumed after stopping the feeding and printing of the tape, the thermal head is caused to print on a portion of the tape printed by an immediately preceding printing operation by the thermal head, in an overlapping manner, by the use of identical printing data or printing data for a next line of dots.

3 Claims, 7 Drawing Sheets

TAPE-PRINTING APPARATUS WITH CONTROL OF FEEDING AND CUTTING OF A TAPE

This is a division of application Ser. No. 08/829,736 filed Apr. 1, 1997, which application is hereby incorporated by reference in its entirety.

BACKGROUND OF THE INVENTION

1. Field of the Invention

This invention relates to a tape-printing apparatus for printing on a tape, and more particular to a tape-printing apparatus which is capable of setting the length of a marginal area defined between a leading cutting position on a tape and a print-starting position on the same.

2. Prior Art

Recently, there comes into use a tape-printing apparatus called a tape printer or a label word processor. According to a tape-printing apparatus of this kind, printing is effected on a front surface of a portion (hereinafter referred to as a "label portion") of a continuous tape, and the label portion is cut off to a desired length. Then, a release paper is peeled off the reverse side of the label portion to thereby reveal an adhesive surface of the label portion, whereby the label portion is made attachable to a desired place as a label or the like. The tape-printing apparatus rapidly comes into wide use as a home-use printing apparatus because of the ease of operation and a low price.

On the other hand, higher levels of function are demanded of this kind of tape-printing apparatus, as well. For example, an ordinary tape-printing apparatus requires a certain distance between a printing operation position of a print head thereof and a cutting operation position of a tape cutter thereof for cutting a continuous tape, due to limitations of a mechanism of the apparatus. Accordingly, a leading margin (i.e. margin at a leading end of a label portion in the direction of feeding of the continuous tape) is necessarily formed on the label portion which corresponds to the distance between the cutting operation position and the printing operation position in the apparatus. However, this leading margin has a length larger than desired of a label by the user. To overcome this inconvenience, the tape-printing apparatus is demanded of a capability of automatically forming a leading margin of the label portion to a length desired by the user. A tape-printing apparatus having the function which meets this demand by the user has been proposed e.g. by Japanese Laid-Open Patent Publication (Kokai) No. 5-84994.

According to the proposed tape-printing apparatus, when the length of a leading margin of a label portion of a tape is set, a position of a leading edge of the leading margin, i.e. a cutting position on the leading end side of the tape where the tape is cut is determined with reference to a print-starting position on the tape where printing is started, and then the label portion is printed by driving a thermal head while feeding the tape to a cutting operation position of a tape cutter. Then, a tape feed motor is stopped to temporarily place the tape in position for cutting. Then, the tape cutter is operated to cut the tape to thereby form the leading margin of the label portion to the length set by the user.

When the leading edge of the label portion has been cut, the driving of the tape feed motor and printing by the thermal head are resumed. When the printing of the label portion is completed, the tape feed motor is further driven until a position of a trailing edge of a trailing margin which is set to a predetermined length similarly to the leading margin, i.e. a cutting position on the trailing end side of the tape where the tape is cut is brought to the cutting operation position, whereupon the label portion is cut off from the tape. Thus, the label is made which is formed with the leading and trailing margins having desired lengths, as a portion preceding the print-starting position on the tape from which a printed portion starts and a portion following a print-terminating position at which the printed portion terminates, respectively.

However, the conventional tape-printing apparatus suffers from the following inconveniences: When the tape cutter operates, the tape is caught between blades of the tape cutter to be pulled forward, resulting in displacement or an undesired forward shift in position of the tape. Further, when the feeding of the tape is suddenly stopped, the reactionary force against stoppage accumulated within a tape-driving mechanism still feeds the tape forward, resulting in an undesired forward shift in position of the tape. Due to these undesired forward shifts in position of the tape, there can be formed a so-called spaced-dots area between dots printed immediately before cutting the tape and dots printed after the printing is resumed. This results in cleaved printed letters or the like, which degrades the quality of print.

On the other hand, if the feeding of the tape is suddenly accelerated, the driving force is absorbed by the tape-driving mechanism of the apparatus to delay the feeding of the tape, which causes displacement or an undesired backward shift in position of the tape. That is, in this case, there can be formed a so-called jammed-dots area between dots printed immediately before cutting of the tape by the tape cutter and dots printed after the printing is resumed. This also degrades the quality of print.

SUMMARY OF THE INVENTION

It is an object of the invention to provide a tape-printing apparatus which is capable of preventing a tape from being displaced or undesirably shifted in position, which tends to occur in the course of feeding and/or cutting of the tape.

It is another object of the invention to provide a tape-printing apparatus which is capable of preventing degradation of the quality of print, which can be caused when the feeding and printing of a tape are stopped and resumed.

To attain the above objects, according to a first aspect of the invention, there is provided a printing apparatus, comprising:

printing means for printing on a continuous tape;

tape-cutting means for cutting the continuous tape at a predetermined cutting position on the continuous tape, after the predetermined cutting position on the continuous tape has passed the printing means;

tape-feeding means in rolling contact with the continuous tape for feeding the continuous tape in a manner such that the continuous tape faces the printing means and the tape-cutting means;

driving means for driving the tape-feeding means for rotation; and control means for operating, when the continuous tape is cut, to cause the driving means to stop driving the tape-feeding means for rotation to thereby stop feeding the continuous tape, and thereafter cause the tape-cutting means to cut the continuous tape, the control means holding the driving means in an energized state during a cutting operation of the tape-cutting means.

According to this tape-printing apparatus, during a cutting operation by the tape-cutting means, the driving means is held in an energized state, whereby permanent magnets of a rotor within the driving means and electromagnets formed by coils on a stator within the same attract each other, to prevent the rotor from rotating. As a result, displacement or an undesired shift in position of the tape is prevented by a larger force than obtained when the driving means is in a non-energized state. That is, it is possible to prevent the operation of the tape-cutting means from causing the displacement of the tape in a forward direction.

Preferably, when the continuous tape is in the process of being printed, the control means causes the tape-cutting means to carry out the cutting operation after the control means causes the tape-feeding means to stop feeding the tape and the printing means to stop printing on the continuous tape.

According to this preferred embodiment, when the tape is cut, the feeding of the tape is stopped and the printing is also stopped. On this occasion, when the tape-cutting means cuts the tape, the displacement of the tape is prevented as described above, so that by resuming the printing and feeding of the tape thereafter, the same quality of print as can be obtained without interrupting the printing and feeding of the tape can be preserved. That is, it is possible to prevent a spaced-dots area from being formed between dots printed immediately before cutting the tape and dots printed immediately after cutting the tape, so that the quality of print can be preserved.

More specifically, the printing means carries out a printing operation for printing on the continuous tape whenever a predetermined amount of feed of the continuous tape is effected by the tape-feeding means, the control means causing the tape-cutting means to carry out the cutting operation after the control means causes the tape-feeding means to stop feeding the tape and the printing operation by the printing means is completed.

More preferably, the printing means comprises a thermal head, and prints one line of dots along width of the continuous tape by the printing operation.

Further preferably, the driving means comprises a stepping motor, and the predetermined amount of feed of the continuous tape corresponds to a predetermined number of steps of rotation made by the stepping motor.

To attain the above objects, according to a second aspect of the invention, there is provided a printing apparatus, comprising:

printing means for printing on a tape;

tape-feeding means for feeding the tape in a manner such that the tape faces the printing means; and control means for controlling operation of the printing means, and operation of the tape-feeding means;

the control means causing the printing means to print on a portion of the tape printed by a printing operation carried out by the printing means immediately after the control means caused the tape-feeding means to stop feeding the tape, in an overlapping manner by the use of identical printing data based on which the printing operation was carried out, when the control means causes the printing means to resume printing on the tape after the control means has caused the tape-feeding means to stop feeding the tape and has caused the printing means to stop printing on the tape.

In general, even if the printing means and the tape-feeding means are simultaneously supplied with respective instruction for stopping their operations or for resuming the same, the printing means, which electrically reacts to an instruction, controls its operation according to the instruction faster than the tape-feeding means which mechanically reacts to an instruction. That is, this difference in the response speed can cause disagreement in timing of printing operations and positions of the tape set by the feeding of the tape. According to the tape-printing apparatus of the second aspect of the prevent invention, when the feeding and printing of the tape are stopped and then resumed, a printing operation is carried out on a portion printed immediately before the stoppage by the use of identical data in an overlapping manner. This makes it possible to prevent the quality of print from being degraded by interruption and resumption of the printing and feeding of the tape even if timing of printing, i.e. a position of the tape for printing and a position of the tape actually set by the feeding thereof do not coincide with each other, or the tape is more or less displaced during stoppage of the tape.

Preferably, the identical data amounts to printing data for one line of dots.

According to this preferred embodiment, when the printing and feeding of the tape are stopped and resumed, one line of dots is printed by the use of identical data in an overlapping manner. This provides, in addition to the advantageous effects of this aspect of the invention described above, an advantageous effect of controlling degradation of the quality of print to the minimum without correcting the position of the tape. That is, even if the tape is shifted or displaced in a forward direction i.e. a tape-feeding direction, the amount of displacement in position is equal to approximately half to one diameter of one dot at the maximum. Therefore, one line of dots is sufficient for the overlapping printing, and the control therefor is easy to carry out since the amount of overlapping printing is so small. Further, even when a shift in position or displacement of the tape occurs, by printing the same line of dots based on identical printing data in a continuous manner, a spaced-dots area becomes less likely to be formed, and even if it is formed, the quality of print can be preserved since the same dots are printed in an overlapping manner.

More preferably, the tape-printing apparatus includes tape-cutting means for cutting off a portion of the tape having passed the printing means, and the printing means carries out a printing operation for printing on the tape whenever a predetermined amount of feed of the tape is effected by the tape-feeding means. After the control means caused the tape-feeding means to stop feeding the tape, and caused the printing means to print on the tape by the printing operation by the use of the printing data for the one line of dots and thereafter stop printing on the tape, the control means causes the tape-cutting means to carry out a cutting operation on the tape, thereafter causes the printing means to carry out a printing operation by the use of the printing data for the one line of dots used immediately before the cutting operation by the tape-cutting means, and causes the tape-feeding means to resume feeding the tape.

According to this preferred embodiment, by carrying out the overlapping printing in such a manner described above, it is possible to prevent the quality of print from being degraded due to interruptions of tape feeding by the tape-feeding means and printing by the printing means for cutting the tape.

It is preferred that the tape-printing apparatus includes means for correcting a position of the tape immediately after the control means caused the tape-feeding means to stop feeding the tape.

Alternatively or in combination, it is preferred that the tape-printing apparatus includes means for correcting a position of the tape immediately before the control means causes the tape-printing means to carry out the printing operation by the use of the printing data for the one line of dots used immediately before the cutting operation by the tape-cutting means.

According to these preferred embodiments, even if a position of the tape for printing and a position of the tape set by feeding of the tape do not coincide with each other due to operations of the apparatus involved in stoppage and resumption of the feeding and printing of the tape, or even if the tape is more or less displaced during stoppage of the tape, it is possible to prevent the quality of print from being degraded due to interruption of the feeding and printing of the tape, by the overlapping printing carried out after correcting the position of the tape.

To attain the above objects of the invention, according to a third aspect of the invention, there is provided a printing apparatus, comprising:

printing means for printing on a tape;

tape-feeding means for feeding the tape in a manner such that the tape faces the printing means; and control means for controlling operation of the printing means, and operation of the tape-feeding means;

the control means causing the printing means to print on a portion of the tape printed by a printing operation carried out by the printing means immediately after the control means causes the tape-feeding means to stop feeding the tape, in an overlapping manner by the use of printing data for a next line of dots, when the control means causes the printing means to resume printing on the tape after the control means causes the tape-feeding means to stop feeding the tape and causes the printing means to stop printing on the tape.

If a spaced-dots area having a width larger than half a diameter of one dot is inevitably formed due to the mechanism of the tape-printing apparatus, printing data for a next line of dots is more preferably used in the overlapping printing than printing data for the same line of dots, from a view point of the quality of print, since results of printing the next line of dots are closer to an ideal state of print. The tape-printing apparatus according to the third aspect of the invention is suitable for overcoming the problem of a spaced-dots area having a width larger than half a diameter of one dot being inevitably formed due to the mechanism of the tape-printing apparatus. By carrying out printing based on printing data for a next line of dots, the same advantageous effects as obtained by the tape-printing apparatus according to the second aspect of the invention can be provided. That is, it is possible to prevent a spaced-dots area from being formed and the quality of print from being degraded. Further, in this apparatus as well, the control is easy to carry out since it is only required to print one line of dots in an specified manner, i.e. without feeding the tape.

Preferably, the tape-printing apparatus includes tape-cutting means for cutting off a portion of the tape having passed the printing means, and the printing means carries out a printing operation for printing on the tape whenever a predetermined amount of feed of the tape is effected by the tape-feeding means. After the control means caused the tape-feeding means to stop feeding the tape, and caused the printing means to print on the tape by the printing operation by the use of the printing data for the one line of dots and thereafter stop printing on the tape, the control means causes the tape-cutting means to carry out a cutting operation on the tape, thereafter causes the printing means to carry out a printing operation by the use of the printing data for the next line of dots, and causes the tape-feeding means to resume feeding the tape.

According to this preferred embodiment, by carrying out the overlapping printing in such a manner described above, it is possible to prevent the quality of print from being degraded due to interruptions of tape feeding by the tape-feeding means and printing by the printing means for cutting the tape.

Preferably, the tape-printing apparatus includes means for correcting a position of the tape immediately before the control means caused the tape-printing means to carry out the printing operation by the use of the printing data for the next line of dots.

In the second and third aspects of the invention, it is preferred that the control means causes the printing means to resume printing on the tape and the tape-feeding means to resume feeding the tape, in a manner such that printing on the tape by the printing means and feeding of the tape by the tape-feeding means are carried out in a progressively accelerated manner.

According to this preferred embodiment, when the printing and feeding of the tape are resumed, operations therefor are progressively accelerated, whereby it is possible to prevent displacement of the tape due to the difference in the response speed between the printing means and the tape-feeding means. This makes it possible to prevent a jammed-dots area from being formed when the printing and feeding of the tape are resumed, and thereby prevent the quality of print from being degraded.

In the second and third aspects of the invention, it is preferred that the control means causes the printing means to stop printing on the tape and the tape-feeding means to stop feeding of the tape, in a manner such that printing on the tape by the printing means and feeding of the tape by the tape-feeding means are carried out in a progressively decelerated manner.

According to this preferred embodiment, when the printing and feeding of the tape are resumed, operations therefor are progressively decelerated, whereby it is possible to prevent displacement of the tape due to the difference in the response speed between the printing means and the tape-feeding means. This makes it possible to prevent the tape from being displaced in a forward or tape-feeding direction when the printing and feeding of the tape are stopped. This makes it possible to prevent a spaced-dots area from being formed, and thereby prevent the quality of print from being degraded.

In the second and third aspects of the invention, it is preferred that the tape-printing apparatus further includes tape-cutting means for cutting off a portion of the tape having passed the printing means, and setting means for setting a length of a leading margin defined as a length between a leading cutting position on the tape and a print-starting position on the tape, and the control means determines the leading cutting position on the tape with reference to the print-starting position on the tape, when the length of the leading margin set by the setting means is shorter than a length of a path along which the tape is fed, between a printing operation position where the printing means prints on the tape and a cutting operation position where the tape-cutting means cuts the tape. While causing the printing means to print on the tape from the print-starting position, the control means causes the tape-feeding means to feed the tape until the leading cutting position on the tape coincides with the cutting operation position of the tape-cutting means, whereupon the control means causes the tape-feeding means to stop feeding of the tape, and the printing means to stop printing on the tape, and then causes the tape-cutting means to cut the tape.

According to this preferred embodiment, it is possible to set the length of a leading margin, and if the length of the leading margin is shorter than a distance or path for feeding the tape between a location of the printing means for printing the tape and a location of the cutting means for cutting the tape within the tape-printing apparatus, a leading cutting position on the tape is determined with reference to a print-starting position on the tape. Printing of the tape from the print-starting position is interrupted to cut off the tape at the leading cutting position, and then the printing of the tape is resumed. In this case, since the advantageous effects described above on the second and third aspects of the invention make it possible to prevent the tape from being displaced during feeding of the tape and due to cutting of the same, the tape can be cut off accurately at the leading cutting position, whereby the leading margin can be obtained as set by the setting means. Further, it is possible to prevent the quality of print from being degraded due to spaced-dots areas and jammed-dots areas, to thereby form labels enhanced in appearance.

The above and other objects, features, and advantages of the invention will become more apparent from the following detailed description taken in conjunction with the accompanying drawings.

DETAILED DESCRIPTION

The invention will now be described in detail with reference to the drawings showing a preferred embodiment thereof.

Figure 1:
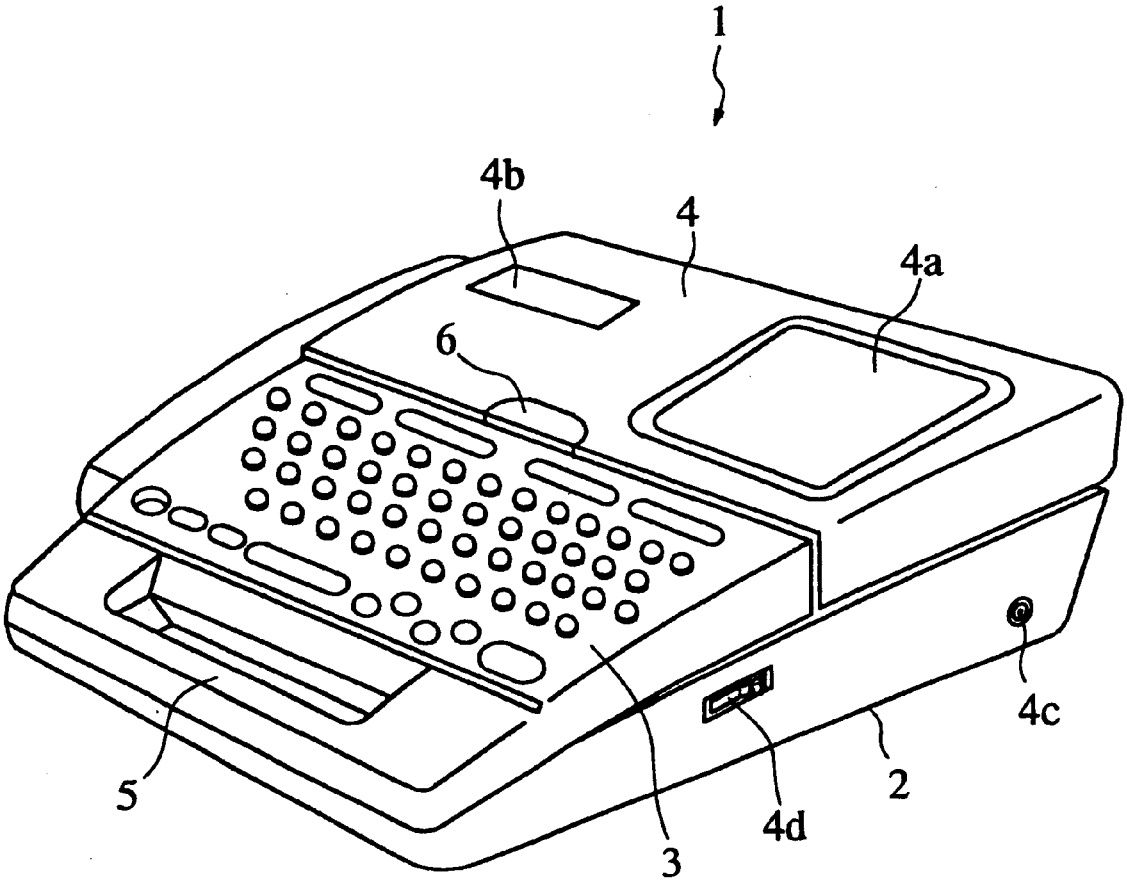
FIG. 1 is a perspective view of an appearance of a tape-printing apparatus according to an embodiment of the invention.

Referring first to FIG. 1, there is shown, in perspective, an appearance of a tape-printing apparatus (hereinafter referred to as "the printing apparatus") . This printing apparatus is what is called a label printer for printing desired characters, symbols, patterns, etc. on a printing tape with a release paper affixed thereto, and cutting a printed portion off the tape to a desired length, to thereby form a label from the tape. The length (of the label) to which the tape is cut off is set such that in addition to the length of a printed portion, there is provided a leading margin with a predetermined length, which precedes the printed portion, and a trailing margin with a predetermined length, which follows the printed portion. Further, the tape is provided in various forms with different tape widths and printing colors, in a state accommodated within a tape cartridge.

Now, the arrangement of the printing apparatus 1 will be described in detail. As shown in FIG. 1, the printing apparatus 1 includes a body casing 2, on the top of which is arranged a keyboard 3 at a front half portion and a lid 4 at a rear half portion which can be opened and closed about the axis at a rear end edge of the printing apparatus. Further, the body casing 2 is formed at a front end with a handle 5 for carrying the printing apparatus 1 thereby. The lid 4 is let open by pushing a lid-opening button 6 arranged in the center of the top of the body casing 2. At a right portion of the top of the lid 4 as viewed in FIG. 1, there is formed a window 4*a* for viewing therethrough a display screen 9*a* of a liquid crystal display 9 (see FIG. 2) arranged within the body casing 2, while at a left portion of the same, a window 4*b* for viewing therethrough to check whether the tape cartridge 7 (see FIG. 2) is loaded in a cartridge-loading block 8 within the body casing 2.

On a right side end of the body casing 2, there is arranged, at a rear portion thereof, a connection port 4*c* for connecting an AC adapter thereto, and at a front portion thereof, a power switch 4*d*. It should be noted that the body casing 2 also has a storage battery-receiving space, not shown, for accommodating a storage battery therein, whereby the printing apparatus can be driven by the storage battery instead of the AC power supply.

Figure 2:
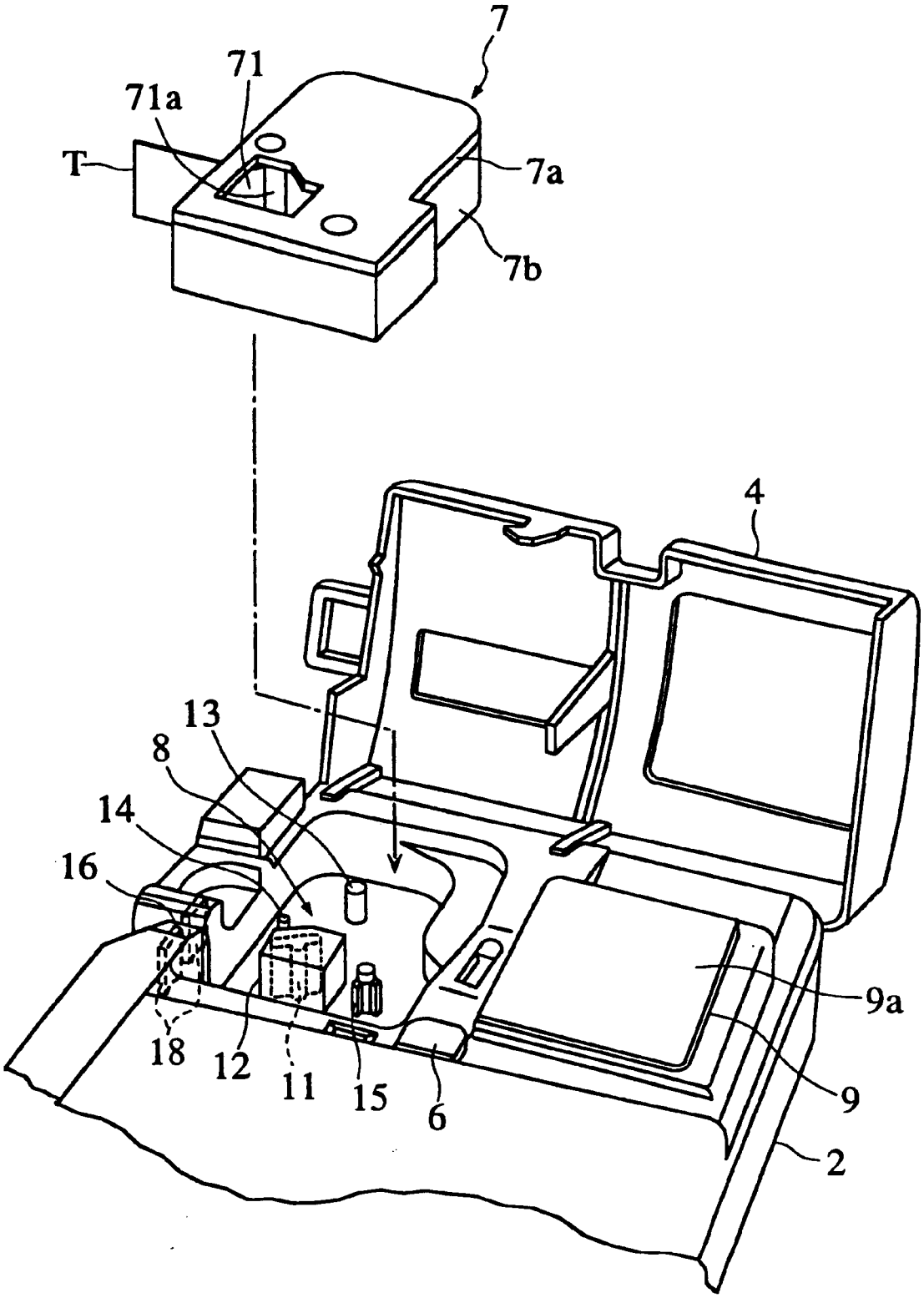
FIG. 2 is a fragmentary view in perspective of the tape-printing apparatus, in a state in which a lid of the tape-printing apparatus is opened and a tape cartridge is removed therefrom.

FIG. 2 shows the tape-printing apparatus with its lid 4 open. As shown therein, the body casing 2 has the aforementioned cartridge-loading block 8 (hereinafter simply referred to as "the loading block 8") formed in a left portion of the interior thereof, in which the tape cartridge 7 can be removably loaded. At a location adjacent to the loading block 8 to the right as viewed in FIG. 2, the aforementioned liquid crystal display 9 is arranged, so that the display screen 9*a* of the liquid crystal display 9 is exposed when the lid 4 is open.

On the bottom of the loading block 8, there are arranged, in a fashion extending upright, a head unit 12 containing a thermal head 11, a positioning pin 13, a platen roller-driving shaft 14, and a ribbon take-up reel-driving shaft 15. When the tape cartridge 7 is loaded, a through hole 71 formed through the tape cartridge is fitted on the head unit 12, a tape reel 72 (more specifically, a central hole 72*a* thereof) on the positioning pin 13, a platen roller 74 (more specifically, a central hole 74*a* thereof) on the platen roller-driving shaft 4, and a ribbon take-up reel 75 (more specifically, a center hole 75*a* thereof) on the ribbon take-up reel-driving shaft 15 (see FIG. 3). In the state of the tape cartridge 7 being loaded, heating elements 11a arranged vertically in a line on the surface of the thermal head 11 are opposed, via a window 71*a* formed in the through hole 71, to the tape T and an ink ribbon R which are fed in a state placed one upon the other on a surface of the platen roller 74.

In a left side end of the body casing 2 opens a tape delivery slit 16 for delivering the tape T from the apparatus. A cutter 18 accommodated within the body casing 2 faces the tape delivery slit 16. The cutter 18 has a scissors-like structure formed by a fixed blade and a movable blade, neither of which is shown. The cuter 18 operates to cut off the tape T in response to the user's operation of a cutter-operating button, not shown, on the keyboard 3 or in a manner linked to operation of a motor 28 (see FIG. 4) which is driven for forming a leading margin and a trailing margin of the label.

Figure 3:
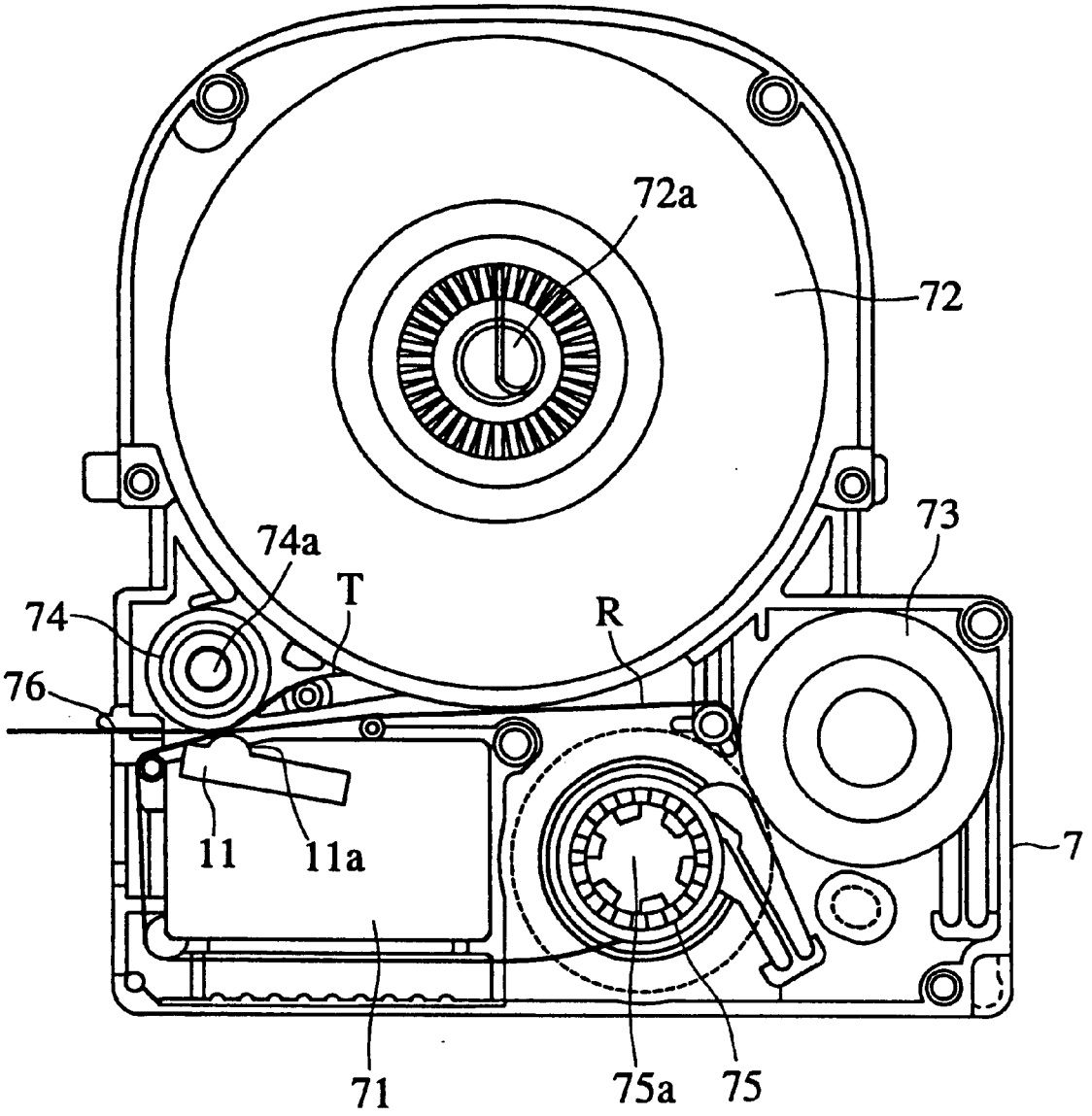
FIG. 3 is a plan view of an internal construction of the tape cartridge of the FIG. 1 tape-printing apparatus.

Next, the construction of the tape cartridge 7 will be described. As shown in FIG. 2, the tape cartridge 7 includes an assembly of an upper casing 7*a* and a lower casing 7*b*. At a lower left portion of the tape cartridge as viewed in FIG. 2 vertically extends therethrough the through hole 71 for being fitted on the head unit 12 extending upright from the bottom of the loading block 8 of the body casing 2. On the other hand, the tape cartridge 7 contains, as shown in FIG. 3, the tape reel 72 for the tape T, a ribbon reel 73 for the ink ribbon R, the platen roller 74, and the ribbon take-up reel 75. The platen roller 74 in a state fitted on the platen roller-driving shaft 14 of the body casing 2 is driven by a stepping motor 41 (see FIG. 4) via the platen roller-driving shaft 14, thereby feeding the tape T at a predetermined speed, i.e. by a predetermined number of steps per unit time. The tape T rolled out from the tape reel 72 is brought into contact with the platen roller 74 which rolls, and further fed out of a delivery slit 76 opening in a side of the lower casing 7*b* of the tape cartridge 7 to the tape delivery slit 16 (see FIG. 2) of the body casing 2, from which the tape T is discharged out of the body casing 2. On the other hand, the ink ribbon R is rolled out from the ribbon reel 73, placed on the tape T, and fed forward along the inner surface of the through hole 71 to be taken up by the ribbon take-up reel 75. The tape T is printed at a position (printing operation position) where the tape T and the ink ribbon R are placed one upon the other. The tape T and the ink ribbon R, placed one upon the other, are held between the platen roller 74 and the head unit 12, for printing. The tape cartridge 7 accommodates e.g. one of six kinds of tapes T having respective widths of 6 mm, 9 mm, 12 mm, 18 mm, 24 mm, and 36 mm.

In the printing apparatus 1 thus constructed, as will be described in detail with reference to FIG. 5, as the platen roller 74 feeds the tape T at a fixed speed, i.e. whenever the tape is fed forward by a predetermined number of steps per unit time, the head unit 12 carries out printing of one line of dots along the width of the tape. When one printing job for printing a label portion is completed, the cutter 18 cuts the tape T to a predetermined length including the length of a printed portion of the label portion. During the printing/feeding process, an unnecessary portion resulting from the spaced arrangement of the head unit 12 and the cutter 18 is cut off from a leading end of the tape T to thereby leave a leading margin having a predetermined length on the tape T. That is, after printing is started, when a position on the tape T corresponding to a leading edge of the leading margin reaches a location of the cutter 18 (cutting operation position), the feeding of the tape T is once stopped, and after completing printing of one line of dots, the unnecessary portion is cut off from the tape T. Then, printing of one line of dots is carried out again, and after the printing of the one line of dots is completed, the feeding of the tape T is resumed to feed the tape T until a position on the tape corresponding to a trailing edge of the trailing margin of the tape T reaches the location of the cutter 18, whereupon the feeding of the tape T is stopped and the label portion is cut off from the tape T (see FIG. 6).

Figure 4:
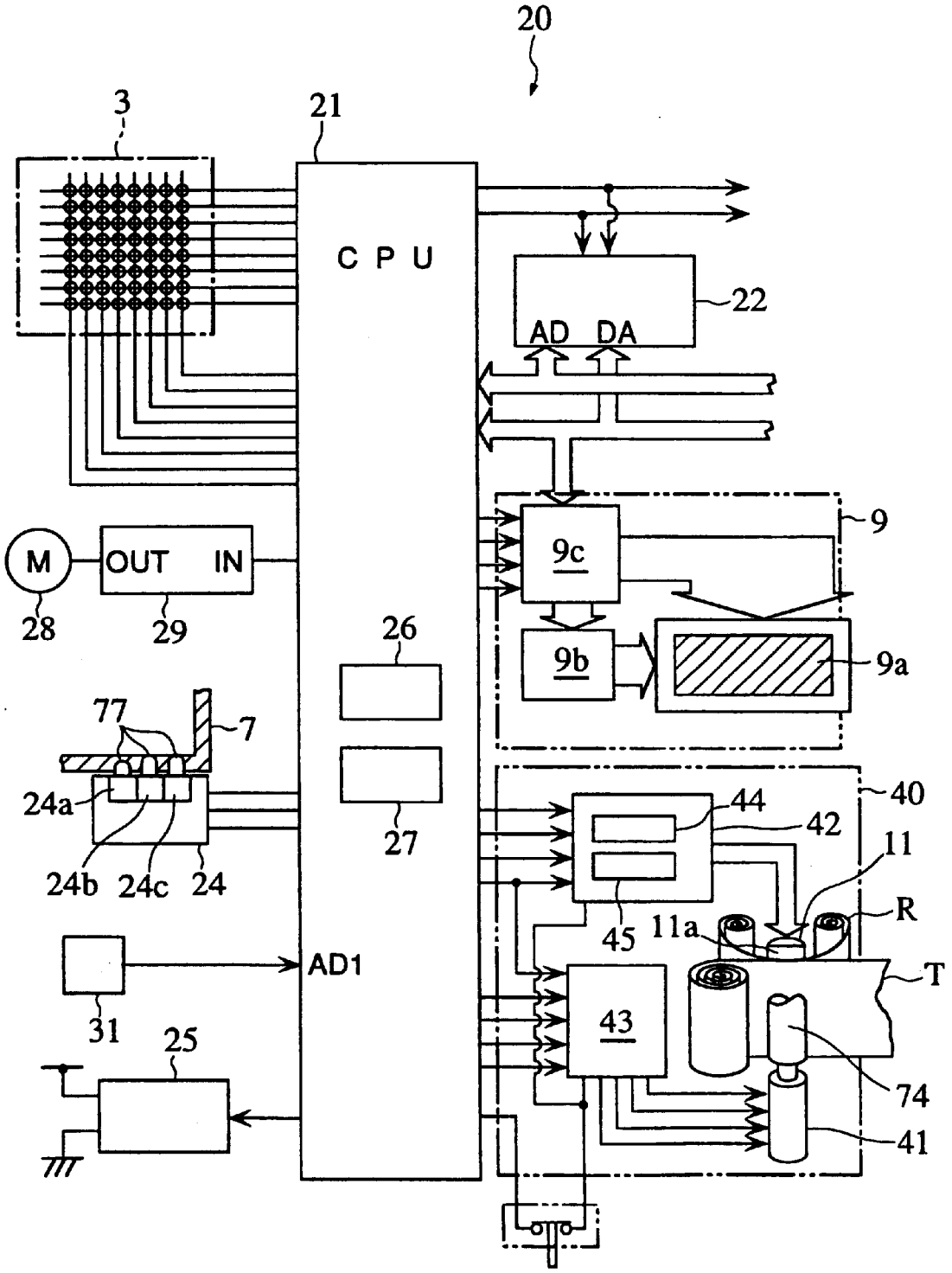
FIG. 4 is a block diagram of a control system of the FIG. 1 tape-printing apparatus.

Next, the construction of a control block which is central to the control system of the printing apparatus 1 will be described with reference to FIG. 4.

The control block 20 is comprised of a one-chip microcomputer 21 (hereinafter referred to as "the CPU") which integrates a ROM (Read Only Memory) storing various operational programs, a RAM (Random Access Memory), and input/output ports, a mask ROM 22, a power supply block 25, a cutter-driving block 29 for driving the motor 28 which causes the cutter 18 to operate, and other circuits for sending and receiving various signals between the CPU 21 and its peripheral circuits.

The CPU 21 includes a first printing data buffer for storing printing data based on which an immediately preceding printing operation was carried out to print a line of dots, and a second printing data buffer 27 for storing printing data based on which a next printing operation is to be carried out to print a line of dots. The CPU 21 measures a time interval of the immediately preceding printing operation carried out based on the printing data stored in the first printing data buffer 26 and the next printing operation to be carried out based on the printing data stored in the second printing data buffer 27, and determines a pulse width of printing pulses based on the time interval thus calculated.

The CPU 21 is connected via an address bus and a data bus, not specifically shown, to the mask ROM 22, and via the data bus to the liquid crystal display 9, and to a printing mechanism 40, for driving these devices, as well as to the keyboard 3, an identifying switch 24, a temperature-detecting circuit 31, for carrying out various control operations in response to output signals therefrom. The mask ROM 22 stores data of letters and symbols, in various fonts, and patterns, therein. The liquid crystal display 9 includes a driver 9*b* for driving the display screen 9*a* thereof and a driver controller 9*c* for controlling the operation of the driver 9*b*. The driver controller 9*c* is connected via the data bus to the CPU 21.

The identifying switch 24 is arranged in a corner of the bottom of the loading block 8 and includes there discriminating switches 24*a* to 24*c* for being inserted into respective tape-discriminating holes formed in the casing assembly of the tape cartridge 7. These identifying switches 24*a* to 24*c* are each turned on when the amount of its projection into the tape cartridge 7 is large, but turned off when the same is small. On the other hand, each of the discriminating holes 77 formed in the tape cartridge 7 has either a large depth or a small depth depending on the width of the tape T accommodated therein. Therefore, the CPU 21 identifies the width of the tape T accommodated within the tape cartridge 7 from outputs from the identifying switch 24, and based on results of the determination, controls the amount of heat produced by the heating elements 11*a* of the thermal head 11.

The temperature-detecting circuit 31 detects an environmental temperature of the thermal head 11, and supplies a signal indicative of the environmental temperature detected by a thermistor as a temperature-sensing element thereof, to an analog-to-digital conversion input port.

The printing mechanism 40 includes the thermal head 11 and the stepping motor 41 as the mechanical components thereof, and a print control gate array 42 and a motor driver 43 as electrical components thereof. The thermal head 11 is constituted by 256 heating elements 11a arranged in a vertical line at regularly-spaced intervals. The stepping motor 41 is controlled in respect of its rotational angle, based on the phase of a four-phase driving signal supplied from the motor driver 43.

The CPU 21 causes the stepping motor 41 to be driven in a predetermined number of steps in synchronism with each printing operation of one line of dots by the thermal head 11 to thereby control the feeding of the tape T. Further, when the cutter 18 cuts the tape C, the CPU 21 holds the stepping motor 41 in an energized state in which the rotation of the stepping motor is inhibited.

The gate array 42 includes a third printing data buffer 44 for storing the same printing data as stored in the first printing data buffer 26 of the CPU 21 in a manner associating the printing data with each of the 256 heating elements 11*a*, and a fourth printing data buffer 45 for storing the same printing data as stored in the second printing data buffer 27 of the CPU 21 in a manner associating the printing data with each of the 256 heating elements 11*a*. The gate array 42 supplies printing pulses with a smaller duration to ones of the heating elements 11*a* each having an accumulation of heat due to the immediately preceding heating operation, and printing pulses with a normal duration to ones of the heating elements 11*a* which were not used in the immediately preceding printing operation, to thereby make uniform the density of print.

Next, margin-setting processing and leading margin-forming processing executed by the printing apparatus 1 will be described. It should be noted that processing operations described below are executed by the CPU 21 unless otherwise specified.

First, the margin-setting processing will be described with reference to FIG. 6. When a margin-setting button, not shown, of the keyboard 3 is operated to enter a length A of a leading margin 91 and a length B of a trailing margin, a length C between the present leading edge 93 of the tape T and a leading end 94 (cutting position on the leading side) of the leading margin 91 is calculated. The length (A+C) between the leading edge 93 of the tape T and a print-starting position 95 on the tape T corresponds a distance along a feed path of the tape T between the cutting operation position of the cutter 18 and the printing operation position of the heating elements 11a of the thermal head, and the ROM integrated in the CPU 21 stores in advance data of the length (A+C).

Next, the leading margin-forming processing will be described with reference to FIG. 5. Printing is started with the stepping motor 41 being driven for feeding the tape. As the leading end 94 of the leading margin 91 comes near to the cutting operation position of the cutter 18, the speed of feeding the tape T is decelerated at a step 101 (hereinafter, a "step S???" will be simply designated as "S???"), and then one line of dots are printed (S102). Then, it is determined based on the length C whether or not the leading end 94 of the leading margin 91 has reached the cutting operation position of the cutter 18 (S103). If it is determined that the leading end 94 of the leading margin 91 has not reached the cutting operation position of the cutter 18, the program returns to S101, whereas if it is determined that the leading end 94 has reached the cutting operation position of the cutter 18, the feeding of the tape T is stopped (S104).

Then, one line of dots are printed (S105), and after completion of the printing of the one line of dots, the driving signal is delivered via the cutter-driving block 29 to the motor 28 to start the cutter 18 (S106). At this time point, the printing position on the tape T corresponds to a position 96 which is spaced from the print-starting position 95 by the length C, as shown in FIG. 6. In this state, the state of supply of driving pulses to the stepping motor 41 is maintained, whereby permanent magnets of a rotor, not shown, within the stepping motor 41 and electromagnets formed by coils on a stator, not shown, within the same attract each other, to prevent the rotor from rotating.

The platen roller 74 driven by the stepping motor 41 holds the tape T in a state pressed against the head unit 12 to thereby prevent the tape T from being displaced, i.e. shifted in position by a larger force than one acting on the tape when the stepping motor is not energized. This enables the tape T to be cut off without displacement caused by a drag by the tape cutter 18. As a result, the printing is resumed without forming a spaced-dots area between the line of dots (at the location 96) printed immediately before the tape cutter 18 cuts the tape T and a line of dots printed after the printing is resumed, to form a continuous printed portion.

Thereafter, it is determined whether or not the operation (cutting operation) of the cutter 18 has been completed (S107) . To make the determination more accurate, it is preferred that a photo interrupter, for example, is provided for detecting the operation of the movable blade of the cutter 18, whereby the above determination is made based on a signal indicative of the sensed operation of the movable blade.

If it is determined that the cutting operation of the cutter 18 has been completed, the supply of the driving signal to the cutter-driving block 29 is stopped to thereby stop the operation of the cutter 18 (S108), and then printing of one line of dots is again carried out based on the printing data used for the immediately preceding printing operation without feeding the tape T (S109). More specifically, the printing data stored in the first printing data buffer 26 of the CPU 21 is again delivered to the gate array 42 to thereby cause the printing operation to be carried out based on the same printing data used for the immediately preceding printing operation.

By this repeated or overlapping printing, even if the cutting operation of the tape cutter 18 has displaced the tape T by half to one diameter of a dot, the same dots as printed by the immediately preceding printing operation are printed in a manner continuous with the preceding printed dots, so that no spaced-dots area is formed. Further, even if the tape T has not been displaced, only the printed dots are printed in an overlapping manner, which prevents the quality of print from being unnecessarily degraded. Further, since only one line of dots are printed, the control therefor is easy to carry out. It should be noted that since the third printing data buffer 44 stores the same printing data used for the immediately preceding printing operation, a print control signal from the CPU 21 may cause the printing data stored in the third printing data buffer to be used for printing for this purpose.

Then, the feeding of the tape is resumed by supplying driving pulses to the stepping motor 41 (S110) . After one line of dots are printed (S111), the repetition period of outputting of driving pulses is shortened to accelerate the feeding of the tape T for printing. The acceleration of feeding of the tape (S112) and the printing of one line of dots (S113) are repeatedly carried out until the printing speed reaches a predetermined value (S114: Yes). When the predetermined printing speed is reached, the acceleration is terminated (S114), and thereafter the printing is continued at the predetermined speed (S115), followed by terminating the program (S116).

Figure 6:
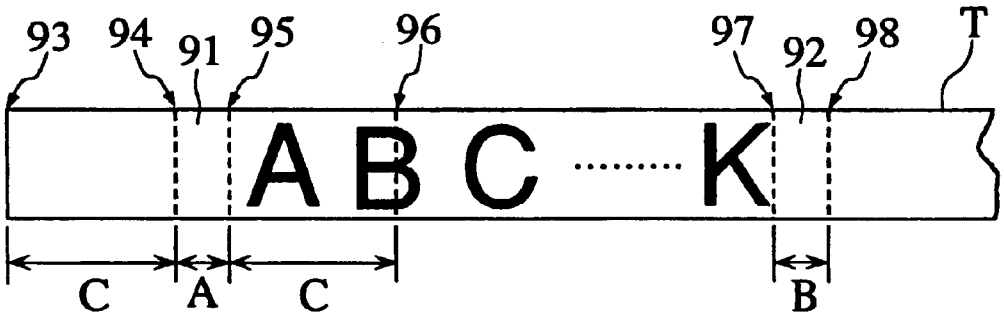
FIG. 6 is a fragmentary plan view of a tape used in the FIG. 1 tape-printing apparatus.

Then, after the whole printing job is completed, the tape T is further fed forward from a print-terminating position 97 by the length B of the trailing margin 92 as shown in FIG. 6, and when the position indicated by reference numeral 98 has reached the cutting operation position of the cutter 18, the feeding of the tape is stopped to cause the cutter 18 to cut off the tape T. This makes it possible to form the label with the leading margin 91 having the length A from the print-starting position 95 and the trailing margin 92 having the length B from the print-terminating position 97. Further, the trailing margin 92 can be formed to an accurate length by cutting the tape T while holding the stepping motor 41 in an energized state.

In general, even if the printing means and the tape-feeding means are simultaneously supplied with instructions for stopping their operations or for resuming the same, the printing means, which electrically reacts to an instruction, has its operation controlled faster than the tape-feeding means which mechanically reacts to an instruction. That is, even if the printing operation and feeding operation of the tape are progressively decelerated or accelerated, the position of the tape set by feeding of the same can be still displaced from a position of the same to be set for printing. To overcome this inconvenience, when the printing and feeding of the tape are stopped and then resumed, displacement of the tape may be first corrected and then printing may be carried out in an overlapping manner (overlapping printing) by the use of the same printing data. This makes it possible to prevent degradation of the quality of print, which can result from interruption and resumption of the printing and feeding of the tape, in a still more reliable manner, even if the position of the tape set by the feeding thereof is displaced from the position of the same for printing due to operations for interrupting and resuming the printing and feeding of the tape, or the tape is more or less moved during stoppage of the tape.

The displacement of the tape can be corrected by storing in advance data obtained from results of experiments for measuring displacements to be expected, and rotating the stepping motor 41 in a reversed direction according to the stored data. This correction may be effected immediately after the printing and feeding of the tape are stopped, or immediately before they are resumed. Further, in this case, empirically, the possible remaining displacement tends to amount to approximately half the diameter of one dot at largest, the overlapping printing is preferably carried out for one line of dots similarly to the FIG. 5 processing. The correction may be carried out by inserting a correcting step immediately after stopping the feeding of the tape (S104) and/or immediately before printing the one line of dots (S109), without adversely affecting other processing operations.

Figure 5:
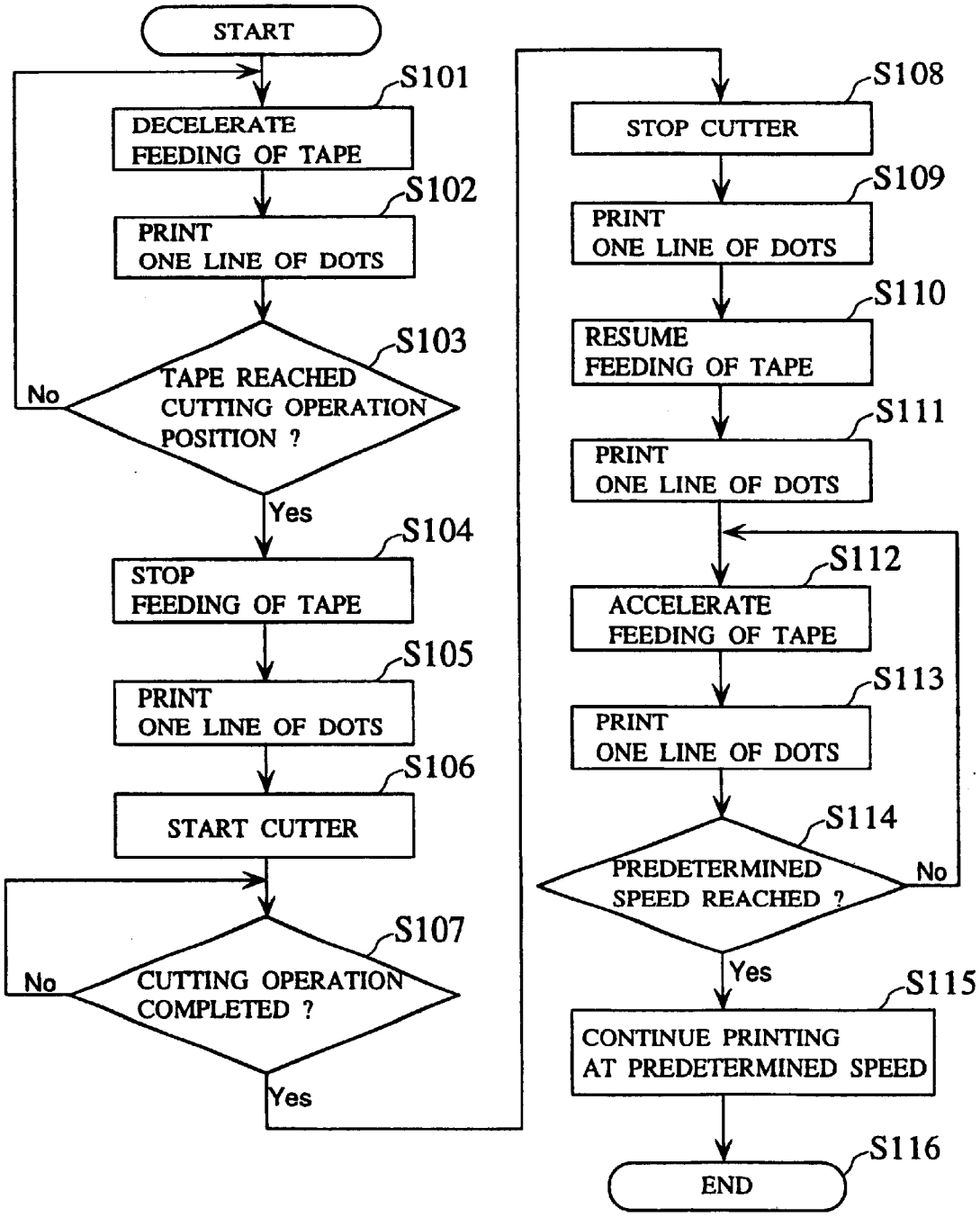
FIG. 5 is a flowchart showing a program for leading margin-forming processing carried out by the FIG. 1 tape-printing apparatus.

Further, in the margin-setting processing of FIG. 5, after the cutter 18 is stopped (S108), one line of dots is printed (S109) without feeding the tape by the use of the same data used for the immediately preceding printing operation. However, there can be cases where the overlapping printing of one line of dots is preferably carried out by using printing data for a next line of dots rather than the printing data used for the immediately preceding printing operation.

Figure 7A:
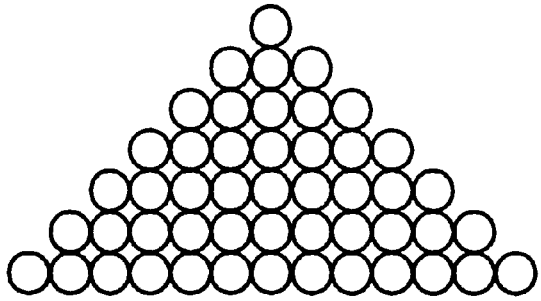
FIGS. 7A to 7D are diagrams which are useful in explaining different manners of printing employed when printing is resumed.
Figure 7B:
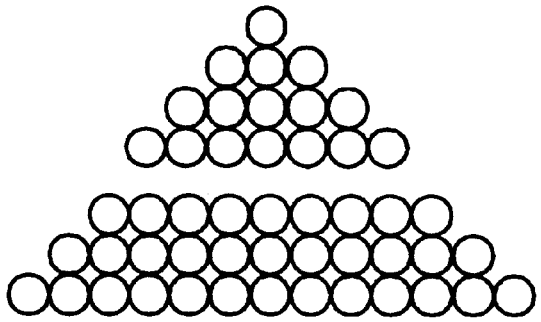
Figure 7C:
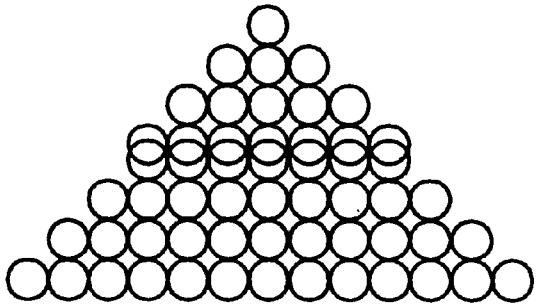
Figure 7D:
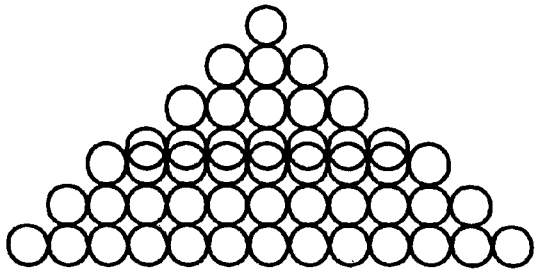

For example, there can be a case in which in the course of printing the figure of a triangle as shown in FIG. 7A, a cutting operation carried out (S106 to S108) by the tape cutter 18 inevitably causes a spaced-dots area as shown in FIG. 7B due to the mechanism of the tape-printing apparatus. If the spaced-dots area is smaller in width than half the diameter of one dot, printing based on the same printing data as used for printing the one line of dots (S109, which corresponds to FIG. 7C) is effective, but if the spaced-dots area is larger in width than the half the diameter of one dot but smaller than that of one dot, printing data for a next line of dots is more suitable for the overlapping printing, as can be understood from results of this printing illustrated in FIG. 7D which are closer to the ideal printing results.

Therefore, the printing of one line of dots (S109) in the FIG. 5 processing may be carried out in a manner suiting the printing/feeding characteristics of the tape-printing apparatus, e.g. by using printing data for a next line of dots, or by selectively using one of identical printing data for a line of dots just printed and printing data for a next line of dots, based on empirical data on results of printing by the tape-printing apparatus. The printing of one line of dots using printing data for a next line of dots can provide the same advantageous effects as obtained when the same printing data for a line of dots just printed is used, i.e. a spaced-dots area is prevented from being formed and the quality of print is prevented from being degraded. In this case as well, the printing control is easy to carry out, since one line of dots is only printed in a specified manner i.e. without feeding the tape.

It is further understood by those skilled in the art that the foregoing are preferred embodiments of the invention, and that various changes and modification may be made without departing from the spirit and scope thereof.

What is claimed is:

1. A printing apparatus, comprising:

printing means for printing on a continuous tape, said printing means including a thermal head;

tape-cutting means for cutting said continuous tape at a predetermined cutting position on said continuous tape, after said predetermined cutting position on said continuous tape has passed said printing means;

tape-feeding means in rolling contact with said continuous tape for feeding said continuous tape in a manner such that said continuous tape faces said printing means and said tape-cutting means;

driving means for driving said tape-feeding means for rotation; and control means for operating, when said continuous tape is cut, to cause said driving means to stop driving said tape-feeding means for rotation to thereby stop feeding said continuous tape, and thereafter cause said tape-cutting means to cut said continuous tape;

said control means holding said driving means in an energized state during a cutting operation of said tape-cutting means;

said control means including means for causing said tape-cutting means to carry out said cutting operation after said control means causes said tape-feeding means to stop feeding said tape and said printing means to stop printing on said continuous tape when said continuous tape is in the process of being printed;

said printing means including means for carrying out a printing operation for printing on said continuous tape whenever a predetermined amount of feed of said continuous tape is effected by said tape-feeding means, said control means causing said tape-cutting means to carry out said cutting operation so as to cut off an unnecessary portion from a leading end of said continuous tape to thereby leave a leading margin of said continuous tape having a predetermined length when a position on said continuous tape corresponding to a leading edge of said leading margin reaches said predetermined cutting position of said tape-cutting means after said control means causes said tape-feeding means to stop feeding said tape and after said printing means prints one line of dots along a width of said continuous tape by said printing operation.

2. A tape-printing apparatus according to claim 1, in which said driving means comprises a stepping motor, said predetermined amount of feed of said continuous tape corresponding to a predetermined number of steps of rotation made by said stepping motor.

3. A printing apparatus, comprising:

a thermal head for printing on a continuous tape;

a tape cutter for cutting said continuous tape at a predetermined cutting position on said continuous tape, after said predetermined cutting position on said continuous tape has passed said thermal head;

a platen roller in rolling contact with said continuous tape for feeding said continuous tape in a manner such that said continuous tape faces said thermal head and said tape cutter;

a stepping motor for driving said platen roller for rotation; and a control device for operating, when said continuous tape is cut, to cause said stepping motor to stop driving said platen roller for rotation to thereby stop feeding said continuous tape, and thereafter cause said tape cutter to cut said continuous tape;

said control device holding said stepping motor in an energized state during a cutting operation of said tape cutter;

said control device causing said tape cutter to carry out said cutting operation after said control device causes said platen roller to stop feeding said tape and said thermal head to stop printing on said continuous tape when said continuous tape is in the process of being printed; and said thermal head carrying out a printing operation for printing on said continuous tape whenever a predetermined amount of feed of said continuous tape is effected by said platen roller, said control device causing said tape cutter to carry out said cutting operation so as to cut off an unnecessary portion from a leading end of said continuous tape to thereby leave a leading margin of said continuous tape having a predetermined length when a position on said continuous tape corresponding to a leading edge of said leading margin reaches said predetermined cutting position of said tape cutter after said control device causes said platen roller to stop feeding said tape and after said thermal head prints one line of dots along a width of said continuous tape by said printing operation.

* * * * *